US010669764B2

(12) United States Patent
Fortin

(10) Patent No.: US 10,669,764 B2
(45) Date of Patent: Jun. 2, 2020

(54) RAIL MODULE WITH CABLE CONDUITS FOR WINDOW REGULATOR SYSTEMS

(71) Applicant: Magna Closures Inc., Newmarket (CA)

(72) Inventor: Raymond Edward Fortin, Newmarket (CA)

( * ) Notice: Subject to any disclaimer, the term of this patent is extended or adjusted under 35 U.S.C. 154(b) by 0 days.

(21) Appl. No.: 15/598,817

(22) Filed: May 18, 2017

(65) Prior Publication Data

US 2018/0334843 A1 Nov. 22, 2018

(51) Int. Cl.

| | |
|---|---|
| ***E05F 11/48*** | (2006.01) |
| ***E05F 15/689*** | (2015.01) |
| ***E05D 15/16*** | (2006.01) |
| ***E05F 11/38*** | (2006.01) |

(52) U.S. Cl.

CPC ..... *E05F 11/488* (2013.01); *E05D 15/165* (2013.01); *E05F 11/382* (2013.01); *E05F 11/485* (2013.01); *E05F 11/486* (2013.01); *E05F 15/689* (2015.01); *E05Y 2201/662* (2013.01); *E05Y 2201/684* (2013.01); *E05Y 2800/20* (2013.01)

(58) Field of Classification Search

CPC ..... E05F 11/488; E05F 11/485; E05F 15/689; E05D 15/165; E05Y 2201/684

USPC ..... 49/352

See application file for complete search history.

(56) References Cited

U.S. PATENT DOCUMENTS

| | | | | |
|---|---|---|---|---|
| 5,333,411 | A * | 8/1994 | Tschirschwitz | E05F 11/486 49/352 |
| 5,657,580 | A * | 8/1997 | Kobrehel | E05F 11/485 49/352 |
| 5,694,717 | A * | 12/1997 | Gier | E05F 11/481 49/348 |
| 5,782,038 | A * | 7/1998 | Sponable | E05F 11/486 49/349 |
| 5,960,588 | A * | 10/1999 | Wurm | B60J 5/0416 49/212 |
| 6,910,730 | B2 * | 6/2005 | Kinoshita | B60J 1/1861 296/146.16 |
| 7,877,932 | B2 * | 2/2011 | Kriese | B60J 1/17 49/348 |
| 2002/0166288 | A1 * | 11/2002 | LeGallo | E05F 11/483 49/352 |
| 2003/0066244 | A1 * | 4/2003 | Staser | E05F 11/385 49/375 |
| 2003/0140562 | A1 * | 7/2003 | Staser | E05F 11/382 49/352 |

(Continued)

*Primary Examiner* — Jerry E Redman

(57) ABSTRACT

An integrated module as a window regulator assembly including: a carrier panel for mounting to a frame of a vehicle closure panel; at least one rail on the carrier panel, the rail associated with at least one cable guide in conjunction with a regulator carriage, the regulator carriage for coupling to a window of the closure panel; a drive mechanism on the carrier panel, the drive mechanism for operating the regulator carriage along a track of the rail; a cable assembly coupling the regulator carriage to the drive mechanism via the cable guide, the cable assembly including a conduit connected at one end to the rail and connected at another end to the drive mechanism, the conduit containing a cable element slideably received within the conduit; wherein the cable element is unsheathed from the conduit where the cable element is in contact with the cable guide.

19 Claims, 7 Drawing Sheets

(56) References Cited

U.S. PATENT DOCUMENTS

2004/0074149 A1* 4/2004 Tatsumi ..... B60J 5/0416 49/352
2004/0134130 A1* 7/2004 Dobson ..... E05F 11/486 49/352
2004/0144032 A1* 7/2004 Smith ..... E05F 11/486 49/352
2006/0037247 A1* 2/2006 Heyer ..... E05F 11/483 49/352
2006/0174543 A1* 8/2006 Rothe ..... E05F 11/385 49/352
2007/0000178 A1* 1/2007 Wild ..... E05F 11/382 49/352
2007/0056219 A1* 3/2007 Martinez Morai .... B60J 5/0416 49/502
2007/0199246 A1* 8/2007 Renke ..... E05F 11/488 49/352
2008/0244981 A1* 10/2008 Arimoto ..... E05F 11/385 49/352
2009/0038227 A1* 2/2009 Costigan ..... B60J 1/17 49/352
2009/0090065 A1* 4/2009 Kinoshita ..... B60J 1/17 49/352
2010/0031575 A1* 2/2010 Kinoshita ..... E05F 11/485 49/352
2010/0223852 A1* 9/2010 Arimoto ..... E05F 11/385 49/352
2013/0283697 A1* 10/2013 Galliot ..... E05F 11/488 49/352
2014/0102007 A1* 4/2014 Pavlovic ..... E05F 11/483 49/352
2015/0191957 A1* 7/2015 Takeda ..... E05F 11/483 49/352
2016/0032637 A1* 2/2016 Johnson ..... E05F 11/525 49/349
2016/0047411 A1* 2/2016 Simonneau ..... F16C 1/265 49/352

* cited by examiner

RAIL MODULE WITH CABLE CONDUITS FOR WINDOW REGULATOR SYSTEMS

FIELD

The present disclosure relates to window regulator systems.

BACKGROUND

Vehicle doors have windows that can be opened and closed. Within the door, there can be a window regulator assembly including a carrier panel, a motor, rails and window regulator lifter or carrier plate assembly which is driven along is respective rail by the motor with associated cabling. There are several problems, however, with these window regulator assemblies. For example, in situations where the window regulator lifter assemblies are driven by cables, pulleys can be used to effect a change in direction for the cables within the regulator assembly, as can cable guides. However, one disadvantage with cable guides is that they introduce additional friction into the window regulator assembly during cable operation. This additional friction can lower the operational efficiency of the window regulator, as well as introduce additional forces that must be accommodated for in the operational and safety design aspects. Pulleys have the advantage of introducing less friction than cable guides due to rotation of the pulley during cable travel. However, the rotation enabled mounting of the pulley on the window regulator assembly can experience tensional stress/strain from the cabling that can result in premature failure of the pulley mounting.

SUMMARY

It is an object of the present invention to provide window regulator systems to obviate or mitigate at least some of the above-presented disadvantages.

A first aspect provided is an integrated module as a window regulator assembly including: a carrier panel for mounting to a frame of a vehicle closure panel; at least one rail on the carrier panel, the rail associated with at least one cable guide in conjunction with a regulator carriage, the regulator carriage for coupling to a window of the closure panel; a drive mechanism on the carrier panel, the drive mechanism for operating the regulator carriage along a track of the rail; a cable assembly coupling the regulator carriage to the drive mechanism via the cable guide, the cable assembly including a conduit connected at one end to the rail and connected at another end to the drive mechanism, the conduit containing a cable element slideably received within the conduit; wherein the cable element is unsheathed from the conduit where the cable element is in contact with the cable guide.

A second aspect provided is the integrated module further comprising: the at least one cable guide includes a first cable guide associated with the rail and a second cable guide associated with a second rail; the second rail on the carrier panel, the second rail associated with the second cable guide in conjunction with the regulator carriage, the regulator carriage for coupling to the window of the closure panel, such that the drive mechanism operates the regulator carriage along a track of the second rail; and the cable assembly including the conduit connected at one end to the second rail and connected at another end of the second rail to the drive mechanism and further including the conduit connecting the first cable guide to the second cable guide, the conduit containing the cable element slideably received within the conduit; wherein the cable element is unsheathed from the conduit where the cable element is in contact with the first cable guide and the second cable guide.

BRIEF DESCRIPTION OF THE DRAWINGS

The foregoing and other aspects will now be described by way of example only with reference to the attached drawings, in which.

DETAILED DESCRIPTION

Figure 1:
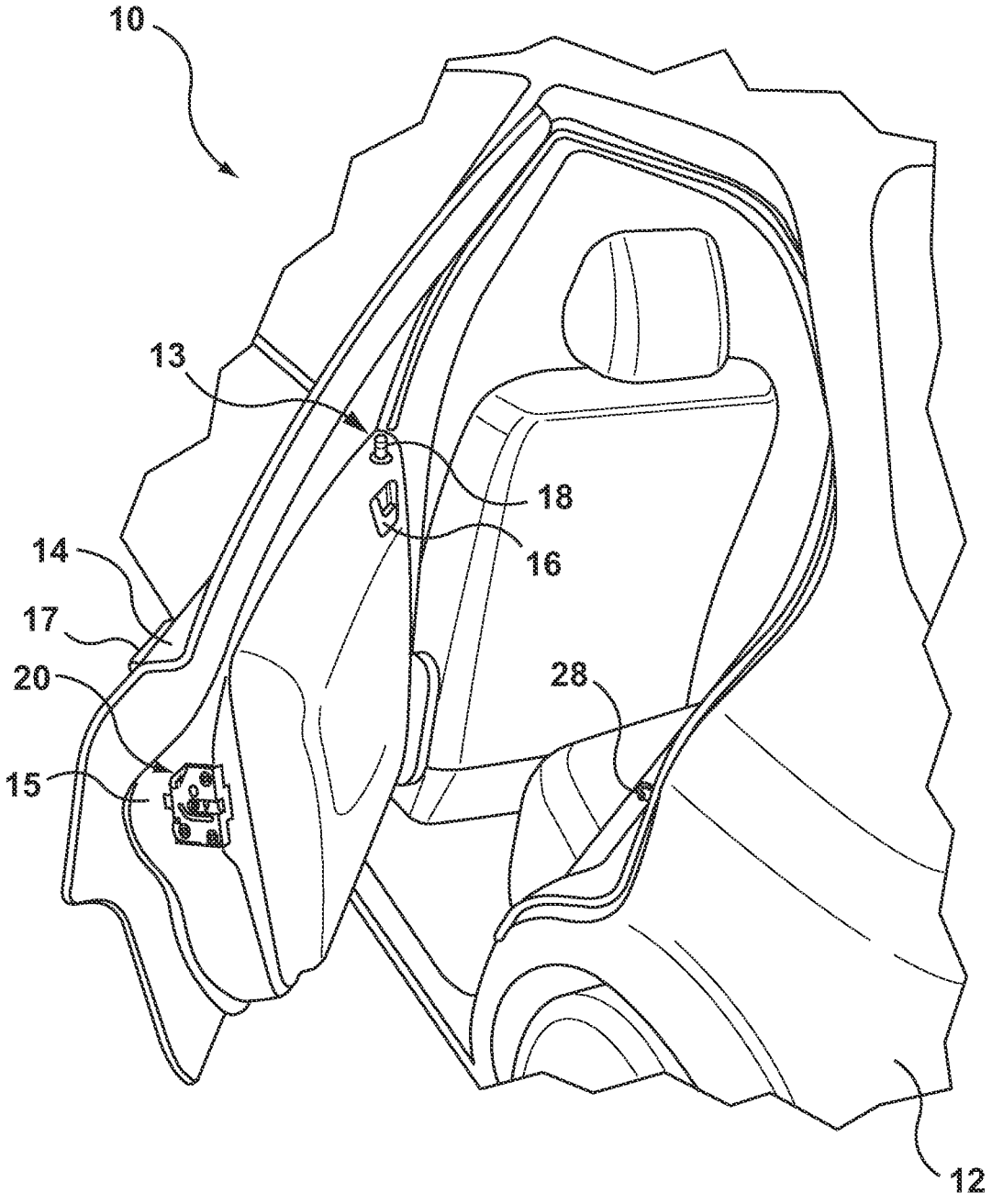
FIG. 1 is a perspective view of a vehicle.

FIG. 1 is a perspective view of a vehicle 10 that includes a vehicle body 12 and at least one vehicle door 14 (also referred to as a closure panel 14). The vehicle door 14 includes a latch 20 that is positioned on a frame 15 of the vehicle door 14, the latch 20 releasably engageable with a striker 28 on the vehicle body 12 to releasably hold the vehicle door 14 in a closed position. The frame 20 also supports a window 13 via a window regulator assembly 30 (see FIG. 2) mounted to the frame 15, as further described below. An outside door handle 17 is provided for opening the latch 20 (i.e. for releasing the latch 20 from the striker 28) to open the vehicle door 14, as well as optionally to operate the window regulator system 30. Further, the vehicle door 14 has an inside control 16 (e.g. door handle, window controls, etc.) for operating the latch 20 and the window regulator assembly 30. A door panel 18 is shown providing a finishing cover (e.g. interior panel) over the window regulator assembly 30 (see FIG. 2) positioned between the frame 15 and the door panel 18.

For vehicles 10, the closure panel 14 can be referred to as a partition or door, typically hinged, but sometimes attached by other mechanisms such as tracks, in front of an opening which is used for entering and exiting the vehicle 10 interior by people and/or cargo. In terms of vehicles 10, the closure panel 14 may be a driver/passenger door, a lift gate, or it may be some other kind of closure panel 14, such as an upward-swinging vehicle door (i.e. what is sometimes referred to as a gull-wing door) or a conventional type of door that is hinged at a front-facing or back-facing edge of the door, and so allows the door to swing (or slide) away from (or towards) the opening in the body 12 of the vehicle 10. Also contemplated are sliding door embodiments of the closure panel 14 and canopy door embodiments of the closure panel 14, such that sliding doors can be a type of door that open by sliding horizontally or vertically, whereby the door is either mounted on, or suspended from a track that provides for a larger opening. Canopy doors are a type of door that sits on top of the vehicle 10 and lifts up in some way, to provide access for vehicle passengers via the opening (e.g. car canopy, aircraft canopy, etc.). Canopy doors can be connected (e.g. hinged at a defined pivot axis and/or connected for travel along a track) to the body 12 of the vehicle at the front, side or back of the door, as the application permits. It is recognized that the body 12 can be represented as a body panel of the vehicle 10, a frame of the vehicle 10, and/or a combination frame and body panel assembly, as desired.

Figure 2:
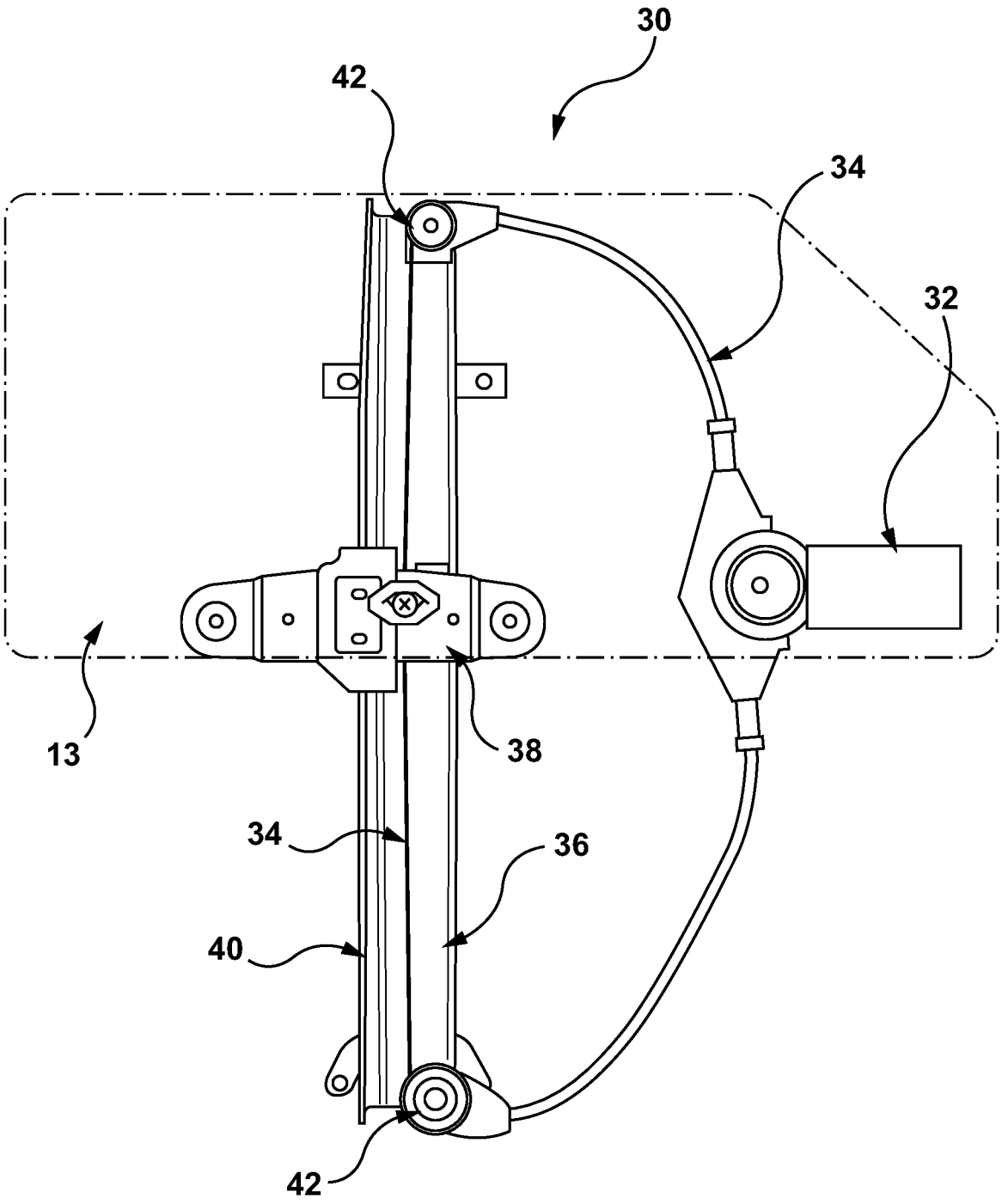
FIGS. 2 and 2A are component views of a window regulator system of the vehicle shown in FIG. 1.
Figure 2A:
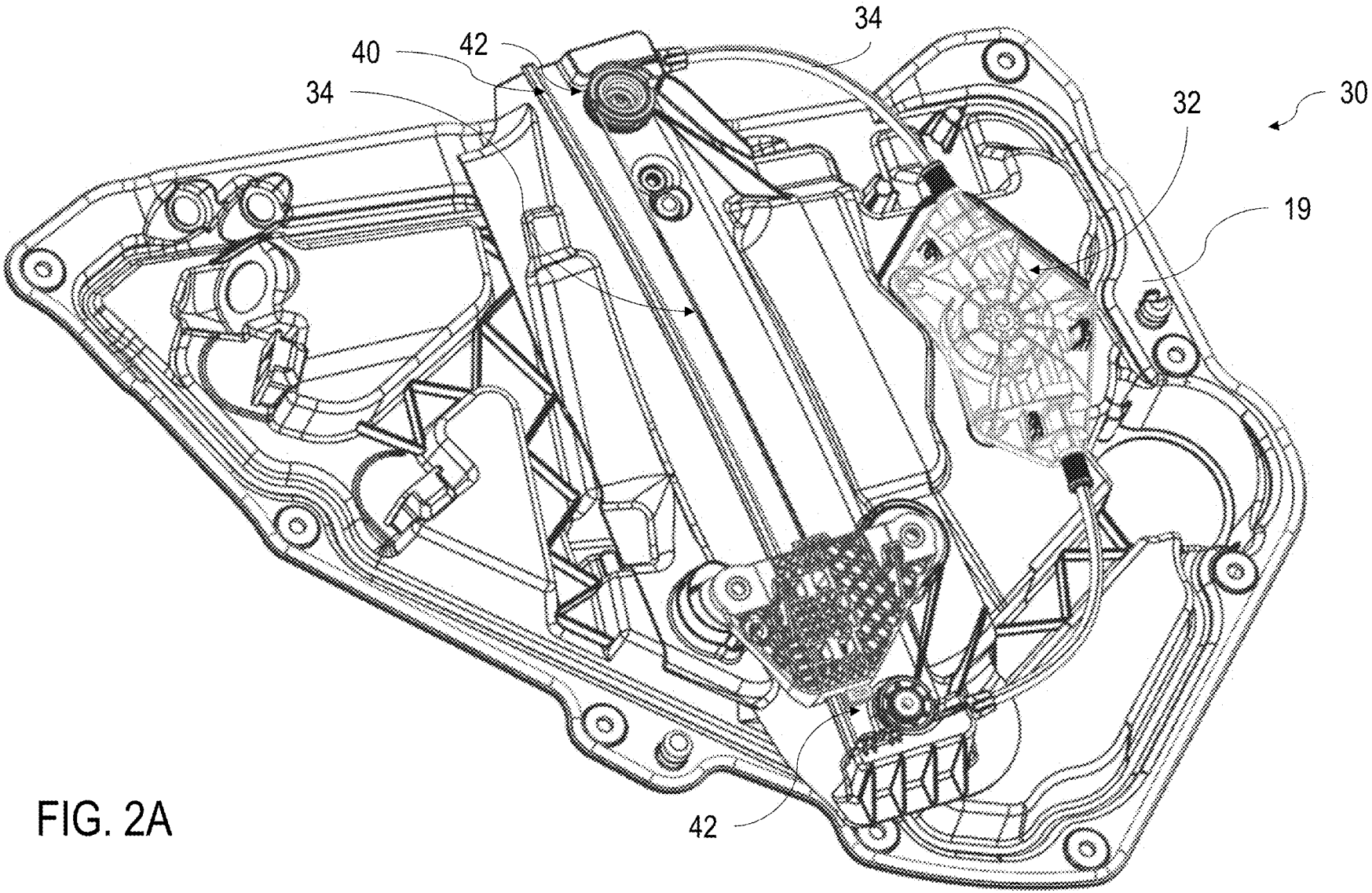

Referring to FIG. 2, the window regulator assembly 30 is for moving the vehicle window 13 up and down, i.e. in and out of an enclosure provided between the frame 15 and the door panel 18. The window regulator assembly 30 includes a drive motor and drive mechanism (e.g. gearing) 32 connected to a set of drive cables 34, one or more rails 36 for mounting on the frame 15 (or on an intervening carrier panel 19 as desired—see FIG. 4), a regulator carriage 38 connected to the window 13 and mounted on the rail 36 for riding along a track 40, and one or more pulleys 42 (e.g. upper pulley and lower pulley) for effecting changes in direction of the drive cables 34. In operation of the window regulator assembly, the drive motor 32 causes movement of the drive cables 34 which in turn propels the regulator carriage 38 towards one end or the other end of the rail 36, depending upon the rotational direction of the drive motor 32 (e.g. as controlled by the door controls 16,17). It is recognized that the rails 36 can be mounted on the carrier panel 19 (providing an integrated rail module as the window regulator system 30) that is itself mounted to the frame 15. Alternatively, the rails 36 and other components (e.g. 32, 34, 36, 38, 42) of the window regulator system 30 can be mounted directly to the frame 15 without the need for the intervening carrier panel 19, providing for a piece-wise assembly of the components (e.g. 32, 34, 36, 38, 42) of the window regulator system 30 directly to the frame 15. It is also recognized that some of the components (e.g. 32, 34, 36, 38, 42) of the window regulator assembly 30 can be mounted to the carrier panel 19 and others of the components (e.g. remaining 32, 34, 36, 38, 42) could be mounted directly to the frame 15 without the intervening carrier panel 19. In a preferred embodiment, the components 32, 34, 36, 38, 42 are mounted to the carrier panel 19 via fasteners 70 (see FIG. 4) and provided as an integrated door module for fastening as an integrated unit to the frame 15 of the closure panel 14 (see FIG. 1).

Figure 3:
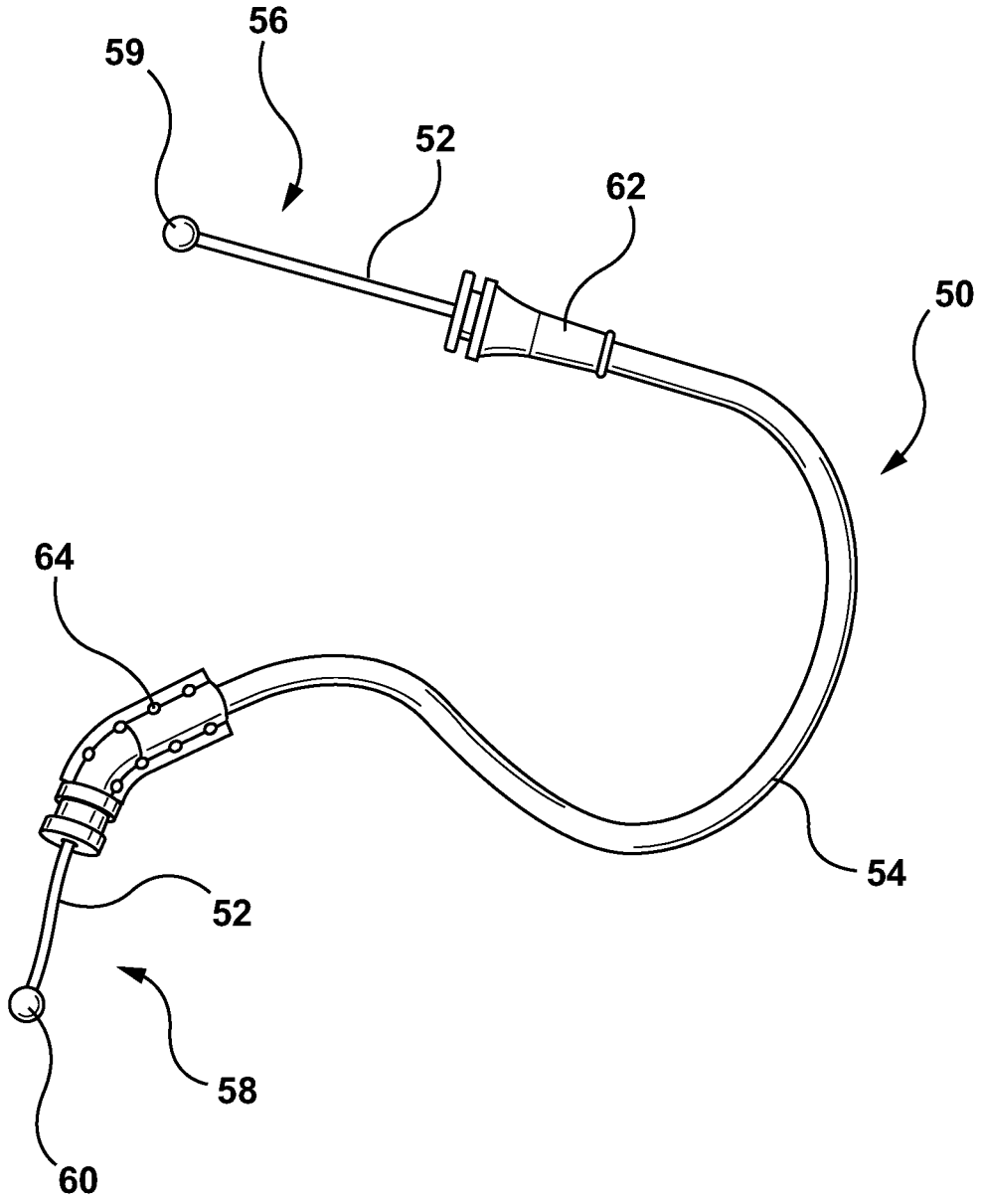
FIG. 3 is a component view of a cable assembly of the window regulator system shown in FIGS. 2 and 2A.

Referring to FIGS. 2 and 3, shown is a cable assembly 50 (e.g. Bowden cable) for transferring tensional loads between opposing ends of the drive mechanism 32, via operation of a core element 52 positioned and slidably received within an interior of a conduit 54. The drive mechanism 32 has a mechanical component such as a ferrule coupled to a first end 56 of the core element 52 and a mechanical component such as a ferrule coupled to a second end 58 of the core element 52. The drive mechanism 32 can be mounted on the carrier panel 19 and/or frame 15 to provide for inhibiting undesirable movement and/or changes in orientation of the drive mechanism 32 when the drive mechanism 32 is under the influence of the tensional loads during operation of the motor that effects travel of the core element 52 within the conduit 54. The core element 52 can also have end fittings 59,60, such that the core element 52 can be connected to the drive system 32 (e.g. via ferrules) via the end fittings 59,60 to inhibit end fitting detachment from the core element 52 and drive system 32 when under the tensional loads. It is recognized that the conduit 54 can be associated with one or more cable carriers (e.g. rotating as pulleys and/or fixed as cable guides), in order to route the core element 52 between the opposite ends of the drive system 32. In other words, the core element 52 could be routed via the pulley(s) 42 (and optionally by shaped guide carriers—not shown—mounted on the frame 15 and/or carrier panel 19) in portions without the use of the conduit 54 (e.g. unsheathed) to route the unsheathed core element 52 in the space between the portions of the cable assembly 50 containing the conduit 54 (i.e. sheathed), as further discussed below.

Referring again to FIGS. 2 and 3, shown is the cable assembly 50 having the core element 52 positioned within the conduit 54, such that the core element 52 is slidably received within the interior of the conduit 54. The core element 52 has the first end 56 and the second end 58, such that the first end 56 can have the core end fitting 59 connected thereto and the second end 58 can also have the core end fitting 60 connected thereto. The conduit 54 has a conduit bushing 62 at the one end 56 for coupling or otherwise anchoring the conduit 54 of the cable assembly 50 to the drive system 32 via an attachment point 31 connected to the drive system 32 (e.g. on the frame of the drive system 32). The conduit 54 has a conduit bushing 64 at the other end 58 for coupling or otherwise anchoring the conduit 54 of the cable assembly 50 to the rail 36 or plate (e.g. a separate component mounted either directly to the rail 36 or coupled indirectly to the rail 38 via the carrier panel 19 and/or frame 15) via an attachment point 29. The conduit bushings 62,64 provide fixed attachment points of the conduit 54 to the drive system 32 and to the rail 36, such that compressive loading is transferred to the conduit 54 when the core element 52 is under the tensioning load during operation of the drive system 32 as mechanically coupled by the cable assembly 50. It is recognized that the rail 36 can be integrated on the carrier panel 19, i.e. both the carrier panel 19 and the rail 36 formed/manufactured as an integrated unit. Alternatively, the rail 36 can be mounted on the carrier panel 19 via one or more fastening means (e.g. threaded fastener, rivet fastener, bonded such as by welding or via adhesive, etc.). Further, the drive system 32 can be mounted on the carrier panel 19 via fastening means as well.

Advantageously, use of the bushings 62,64 and associated attachment points 29,31 transfer the tension load of the core element 32 off of the pulleys 42 and onto the rail 36 (or plate attached thereto) and drive system 32 (or plate attached thereto). In this manner, the attachment points (e.g. pulley rivet) of the pulleys 42 with the carrier plate 19 (and/or frame 15) realize reduced strain/stress loading associated with tensioning of the cable element 52, as at least a portion of all of the strain/stress loading associated with tensioning of the cable element 52 is carried by the mechanical coupling between the attachment points 29,31 and the bushings 62,64 rather than at the connection (see FIG. 5) between the pulley 42 and the frame 15 and/or carrier panel 19.

Figure 5:
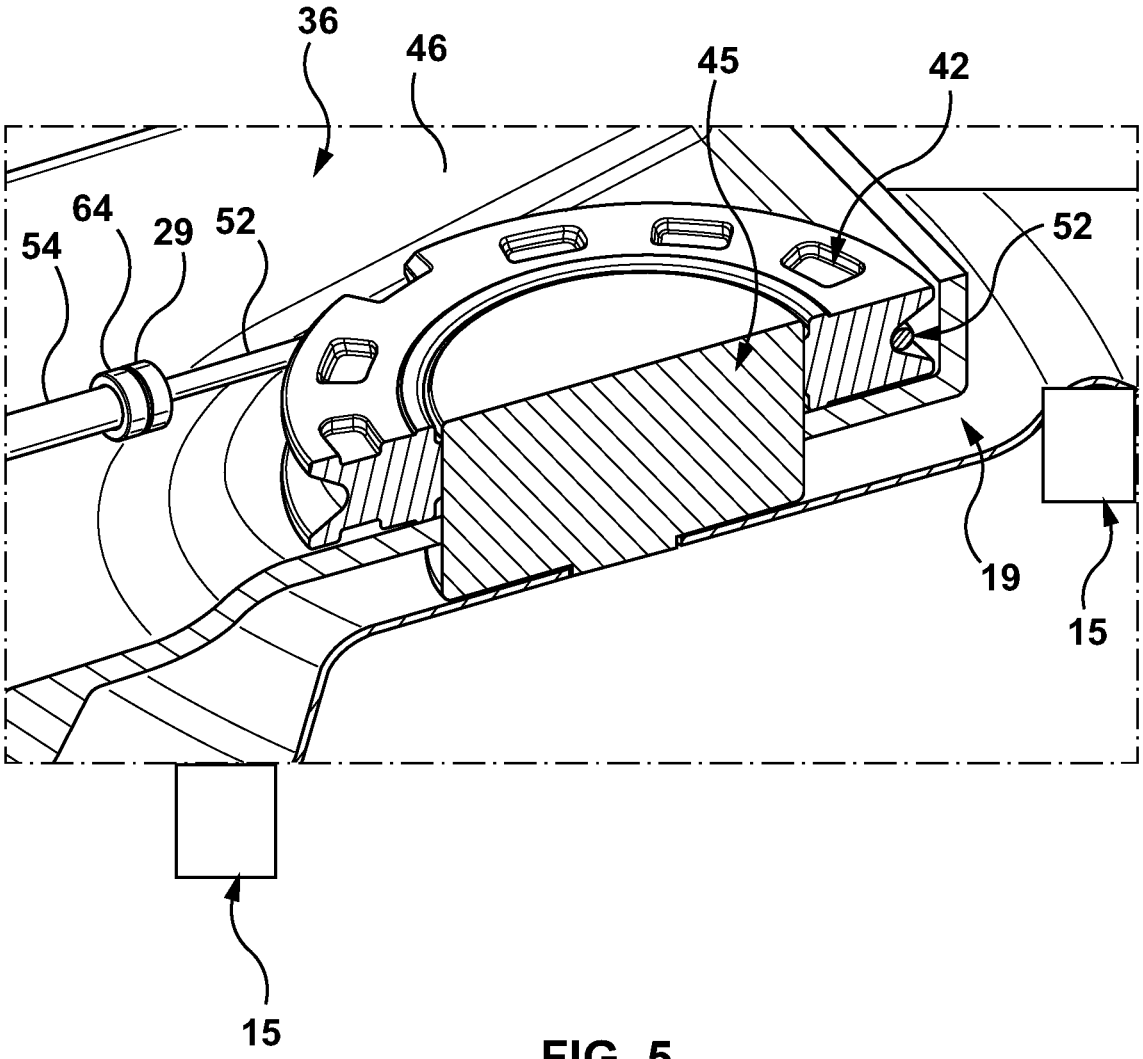
FIG. 5 is an example pulley of the window regulator system shown in FIG. 2.

FIG. 5 shows an example connection between the pulley 42 and the rail 36 (and the carrier panel 19) via a pulley connector 45. The attachment point 29 is fixed to a body 46 of the rail 36 and the bushing 64 (connected to the conduit 54 at one end) is mechanically connected (e.g. via mechanical fasteners) thereto.

Figure 4:
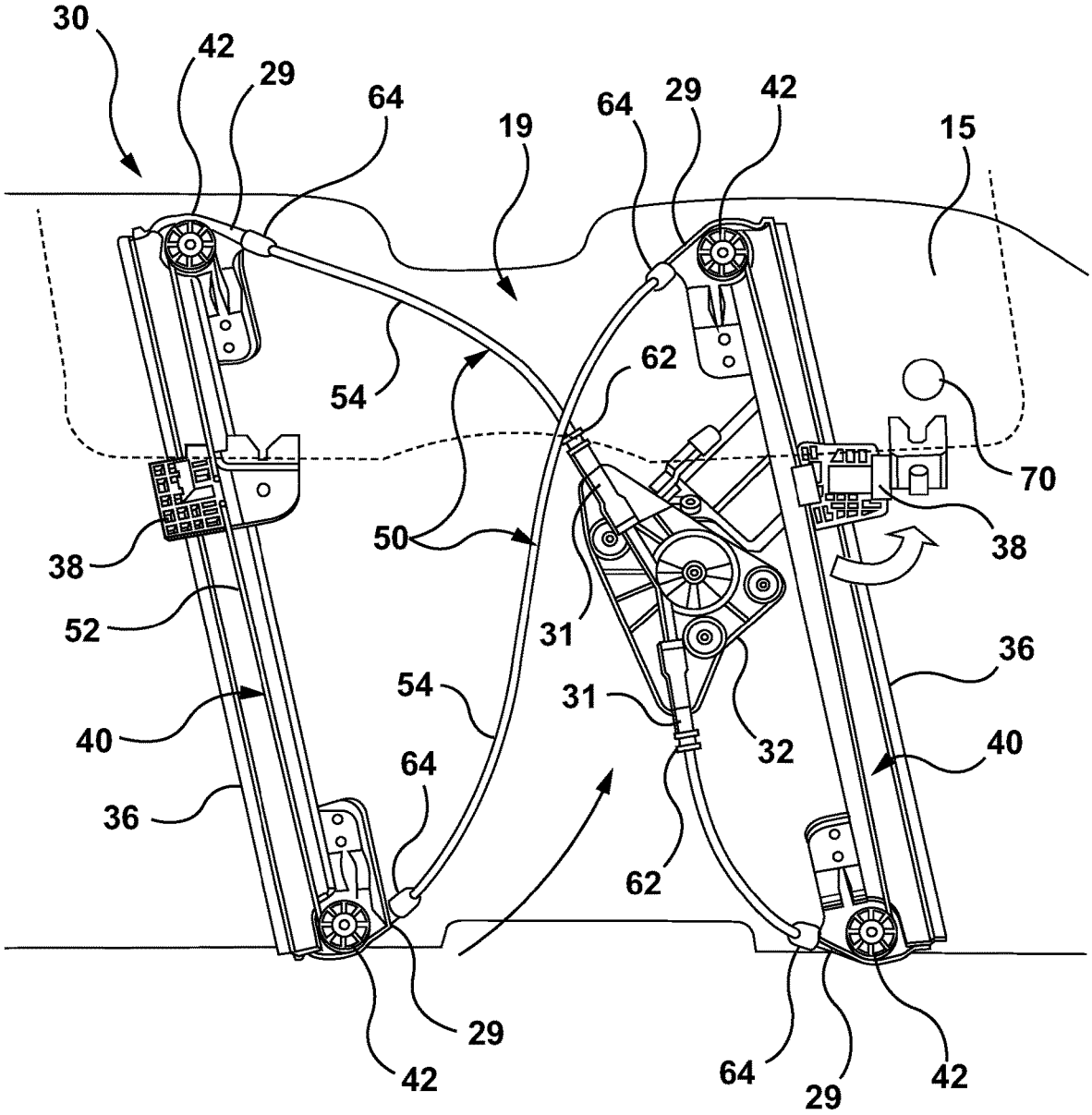
FIGS. 4 and 4A are alternative embodiments of the window regulator system shown in FIG. 3.
Figure 4A:
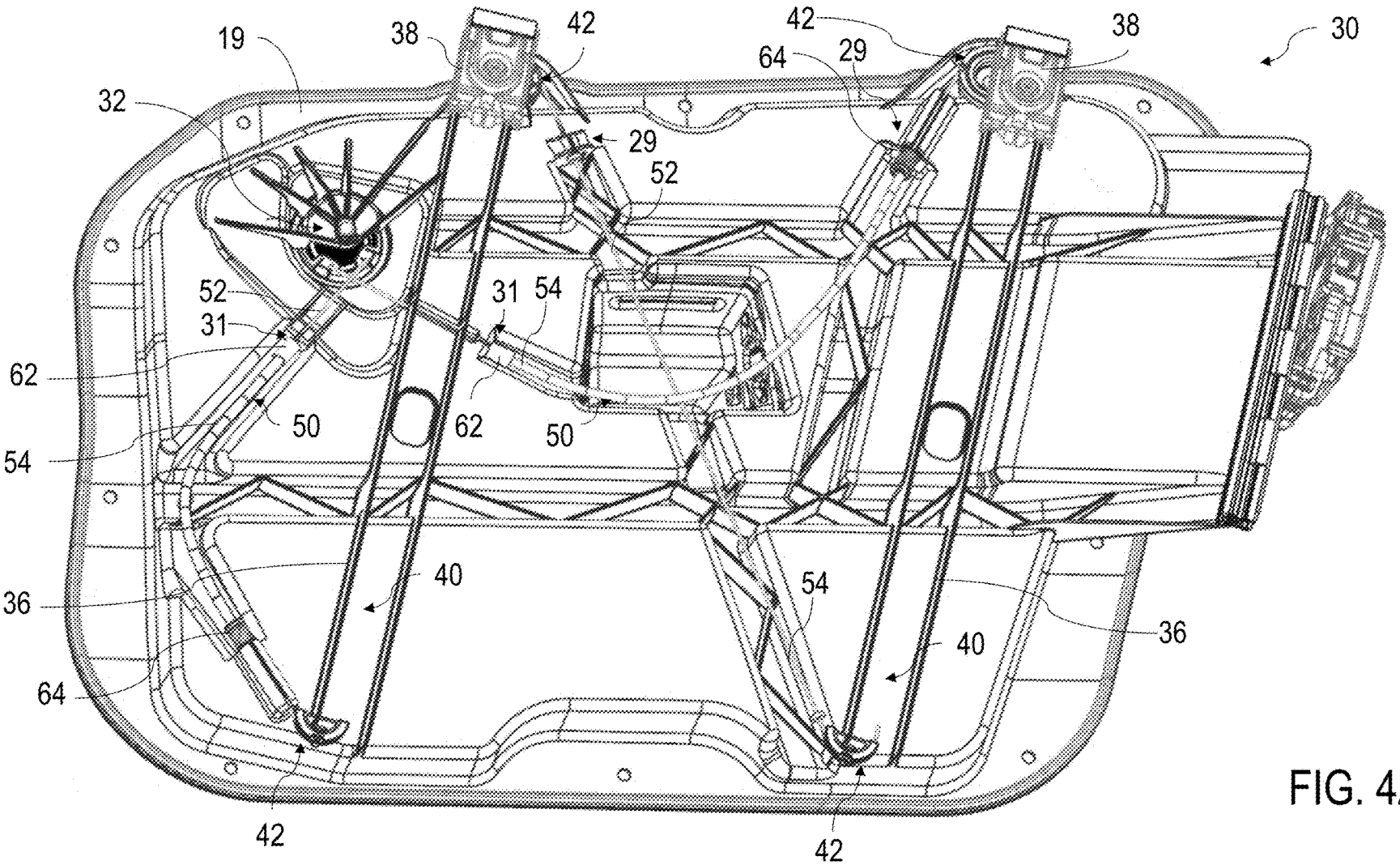

Referring to FIG. 4, one embodiment of the cable assembly 50, as a window regulator assembly 30 assembled on the carrier panel 19 as an integrated door module, is where the regulator carriage(s) 38 (i.e. window regulator lifter assembly) are coupled via the cable assembly 50 (i.e. acting as a window regulator cable assembly) to the drive system 32 attached to the window motor. In this example, the cable assembly 50 is configured in the window regulator system 30 as a tension cable arrangement, such that the cable assembly 50 provides an operative mechanical linkage between the regulator carriage(s) 38 and the window drive system 32 positioned at a location remote to the regulator carriage(s) 38 on the carrier panel 19. Accordingly, when the vehicle window switch 16 (see FIG. 1) activates the window motor, the release cable (e.g. core element 52) is pulled by a lever (e.g. of the drive system 32) and transmits the motor actuation to the regulator carriage(s) 38, which in-turn either opens or closes the window 13 of the vehicle door 14. It is recognised that the conduit 54 can be included or otherwise substituted in portions by one or more carriers as is known in the art, in order to route the core element 54 between the opposing ends of the rail 36 and/or between the rail 36 and the drive system 32. Shown in FIG. 4 is the use of pulley(s) 42 to direct the core portion 52 when unsheathed (e.g. lacking the conduit 54) between opposing pulleys 42 situated along the rail 36. Attachment of the cable assembly 50 at one end 58 (see FIG. 3) to the rail 36 is by the bushing 64. Attachment of the cable assembly 50 at one end 56 (see FIG. 3) to the drive system 32 is by the bushing 62. Further, attachment between different rails 36 of the same window regulator system 30 can be by the cable assembly 50, such that attachment of the cable assembly 50 at one end 58 (see FIG. 3) to the first rail 36 is by the bushing 64 and attachment of the cable assembly 50 at the other end 56 (see FIG. 3) to the second rail 36 is by the bushing 62.

It is recognized that the cable assembly 50 can be mounted directly on the rail 36 (i.e. the bushing 64 is mechanically connected to the attachment point 29 that is on the rail 36 itself and the rail 36 is connected to the carrier panel 19 (or frame 15)). It is recognized that the cable assembly 50 can be mounted directly on the drive mechanism 32 (i.e. the bushing 62 is mechanically connected to the attachment point 31 that is on the drive mechanism 32 itself and the drive mechanism 32 is connected to the carrier panel 19 (or frame 15)). Alternatively, the cable assembly 50 can be mounted on the carrier panel 19 (or frame 15) adjacent to the rail 36 (i.e. the bushing 64 is mechanically connected to the attachment point 29 that is on the carrier panel 19 (or frame 15) itself and the rail 36 is separately connected to the carrier panel 19 (or frame 15)). Alternatively, the cable assembly 50 can be mounted on the carrier panel 19 (or frame 15) adjacent to the drive mechanism 32 (i.e. the bushing 62 is mechanically connected to the attachment point 31 that is on the carrier panel 19 (or frame 15) itself and the drive mechanism 32 is separately connected to the carrier panel 19 (or frame 15)). In the case where the attachment point 29,31 is not on the rail 36/drive mechanism 32 itself, the cable element 52 can be unsheathed (i.e. without conduit 54) between the attachment point 29,31 and the rail 36/drive mechanism 32 respectively.

It is also recognized that the pulley 42 (a rotational cable guide) can be substituted by a fixed cable guide (e.g. a shaped cable guide that is non-rotating) in the window regulator system 30.

While the above description constitutes a plurality of embodiments, it will be appreciated that the present disclosure is susceptible to further modification and change without departing from the fair meaning of the accompanying claims.

I claim:

1. An integrated module as a window regulator assembly including:

a carrier panel for mounting to a frame of a vehicle closure panel;

a rail positioned on the carrier panel, the rail associated with a cable guide in conjunction with a regulator carriage, the regulator carriage for coupling to a window of the closure panel, the cable guide attached by a connector directly to the carrier panel via aligned apertures of the cable guide and a body of the rail;

a drive mechanism mounted directly on the carrier panel and separate from the rail and thus remote from the regulator carriage, the drive mechanism for operating the regulator carriage along a track of the rail; and a cable assembly coupling the regulator carriage to the drive mechanism via the cable guide, the cable assembly including a conduit, the conduit containing a cable element slideably received within the conduit.

2. The integrated module of claim 1, wherein the cable assembly is mounted by a first attachment point of the conduit directly on the carrier panel at one end of the conduit and mounted by a second attachment point of the conduit directly on the carrier panel at another end of the conduit.

3. The integrated module of claim 2, wherein the cable assembly is mounted on the carrier panel adjacent to the rail.

4. The integrated module of claim 2, wherein the cable assembly is mounted on the carrier panel adjacent to the drive mechanism.

5. The integrated module of claim 1, wherein the cable assembly is mounted directly on the drive mechanism.

6. The integrated module of claim 1, wherein the cable guide is a pulley.

7. The integrated module of claim 6, wherein the pulley is mounted on the rail.

8. The integrated module of claim 1, wherein the cable guide is a pair of cable guides mounted on opposite ends of the rail, such that the cable assembly is connected to the carrier panel adjacent each of the cable guides via a respective bushing for transferring tensioning loads to the conduit from the cable element during operation of the drive mechanism.

9. The integrated module of claim 8, wherein the pair of cable guides are pulleys and the respective bushings transfer at least a portion of the tensioning loads from the pulleys to the rail in order to reduce stress at the first attachment point on the carrier panel between each pulley of the pair of pulleys and the rail.

10. The integrated module of claim 9, wherein said cable element is unsheathed between the pair of pulleys.

11. The integrated module of claim 1 further comprising:

the cable guide includes a first cable guide associated with the rail and a second cable guide associated with a second rail;

the second rail on the carrier panel, the second rail associated with the second cable guide in conjunction with the regulator carriage, the regulator carriage for coupling to the window of the closure panel, such that the drive mechanism operates the regulator carriage along a track of the second rail; and the cable assembly including the conduit connected at one end to the second rail and connected at another end of the second rail to the drive mechanism and further including the conduit connecting the first cable guide to the second cable guide, the conduit containing the cable element slideably received within the conduit;

wherein the cable element is unsheathed from the conduit where the cable element is in contact with the first cable guide and the second cable guide.

12. The integrated module of claim 11, wherein the first cable guide and the second cable guide are pulleys.

13. The integrated module of claim 12 further comprising the cable assembly being connected to each of the pulleys via a respective bushing for transferring tensioning loads to the conduit from the cable element during operation of the drive mechanism.

14. The integrated module of claim 13, wherein the respective bushings transfer at least a portion of the tensioning loads from the pulleys to the rails in order to reduce stress at the first attachment point between the first pulley of the rail and the second pulley of the second rail.

15. The integrated module of claim 13, wherein the cable element is sheathed between the first pulley and the second pulley.

16. The integrated module of claim 15, wherein the first pulley is attached to a body of the first rail and the second pulley is attached to a body of the second rail.

17. The integrated module of claim 1, wherein the cable element is unsheathed from the conduit where the cable element is in contact with the cable guide.

18. The integrated module of claim 1, wherein the cable assembly is mounted by a first attachment point of the conduit directly on the rail at one end of the conduit and mounted by a second attachment point of the conduit directly on the drive mechanism at another end of the conduit.

19. The integrated module of claim 1, wherein the cable assembly is mounted by a first attachment point of the conduit directly on the carrier panel at one end of the conduit and mounted by a second attachment point of the conduit directly on the drive mechanism at another end of the conduit.

* * * * *